US009019187B2

(12) United States Patent
Moon et al.

(10) Patent No.: US 9,019,187 B2
(45) Date of Patent: Apr. 28, 2015

(54) LIQUID CRYSTAL DISPLAY DEVICE INCLUDING TFT COMPENSATION CIRCUIT

(71) Applicant: LG Display Co., Ltd., Seoul (KR)

(72) Inventors: TaeWoong Moon, Gyeonggi-Do (KR); YounGyoung Chang, Gyeonggi-Do (KR); ChongHun Park, Gyeonggi-Do (KR); IlKi Jung, Chungcheongbuk-Do (KR)

(73) Assignee: LG Display Co., Ltd., Seoul (KR)

( * ) Notice: Subject to any disclaimer, the term of this patent is extended or adjusted under 35 U.S.C. 154(b) by 171 days.

(21) Appl. No.: 13/728,028

(22) Filed: Dec. 27, 2012

(65) Prior Publication Data

US 2014/0091996 A1 Apr. 3, 2014

(30) Foreign Application Priority Data

Sep. 28, 2012 (KR) ..... 10-2012-0109250

(51) Int. Cl.
*G09G 3/36* (2006.01)

(52) U.S. Cl.
CPC ..... *G09G 3/3685* (2013.01); *G09G 2300/0413* (2013.01); *G09G 2310/0297* (2013.01); *G09G 2320/045* (2013.01)

(58) Field of Classification Search
CPC ..... G09G 3/3685
USPC ..... 345/92, 100
See application file for complete search history.

(56) References Cited

U.S. PATENT DOCUMENTS

| | | | | |
|---|---|---|---|---|
| 5,585,949 | A * | 12/1996 | Yamazaki et al. | 349/41 |
| 7,834,676 | B2 * | 11/2010 | Lee et al. | 327/362 |
| 2002/0089476 | A1 * | 7/2002 | Kang | 345/87 |
| 2005/0162354 | A1 * | 7/2005 | Osame et al. | 345/76 |
| 2007/0146289 | A1 * | 6/2007 | Lee et al. | 345/100 |
| 2009/0102779 | A1 * | 4/2009 | Jo | 345/101 |
| 2009/0167668 | A1 * | 7/2009 | Kim | 345/100 |

(Continued)

FOREIGN PATENT DOCUMENTS

| | | |
|---|---|---|
| KR | 10-2009-0119599 | 11/2009 |
| KR | 10-2011-0068238 | 6/2011 |

(Continued)

OTHER PUBLICATIONS

Korean Office Action dated Nov. 30, 2013 for corresponding Patent Application No. 10-2012-0109250.

(Continued)

*Primary Examiner* — Jason Olson
*Assistant Examiner* — Deeprose Subedi
(74) *Attorney, Agent, or Firm* — Morgan, Lewis & Bockius LLP

(57) ABSTRACT

The present invention relates to a liquid crystal display (LCD) device. More particularly, the present invention relates to an LCD device including a thin film transistor (TFT) compensation circuit in an LCD device which implements a driving circuit by using an oxide TFT, the LCD device capable of compensating for degraded characteristics of a TFT due to threshold voltage shift. As the compensation circuit including a dummy TFT is formed on a non-active area of the LC panel, the degree of threshold voltage shift of the DT due to a DC voltage can be sensed. Based on the sensed result, a threshold voltage of a second TFT can be compensated. This can reduce lowering of a device characteristic.

13 Claims, 7 Drawing Sheets

(56) References Cited

U.S. PATENT DOCUMENTS

| | | | | |
|---|---|---|---|---|
| 2009/0256794 | A1* | 10/2009 | Jang et al. | 345/100 |
| 2011/0134093 | A1* | 6/2011 | Chen | 345/211 |
| 2014/0035896 | A1* | 2/2014 | Lin et al. | 345/212 |

FOREIGN PATENT DOCUMENTS

KR 1020120011966 A 2/2012

KR 1020120069481 A 6/2012

OTHER PUBLICATIONS

Notice of Allowance dated Aug. 29, 2014 from the Korean Intellectual Property Office in counterpart KR Patent Application No. 10-2012-0109250.

* cited by examiner

LIQUID CRYSTAL DISPLAY DEVICE INCLUDING TFT COMPENSATION CIRCUIT

CROSS-REFERENCE TO RELATED APPLICATION

Pursuant to 35 U.S.C. §119(a), this application claims the benefit of earlier filing date and right of priority to Korean Application No. 10-2012-0109250, filed on Sep. 28, 2012, the contents of which is incorporated by reference herein in its entirety.

BACKGROUND OF THE INVENTION

1. Field of the Invention

The present disclosure relates to a liquid crystal display (LCD) device, and particularly, to an LCD device including a thin film transistor (TFT) compensation circuit in a structure where a driving circuit is implemented by an oxide TFT, the LCD device capable of compensating for degraded characteristics of the TFT due to threshold voltage shift.

2. Background of the Invention

With development of information electronic devices including various types of portable devices such as a mobile phone and a notebook computer, an HDTV, etc. for implementing images of high resolution and high quality, demands for flat panel display devices applied thereto increase. Such flat panel display devices include LCD(Liquid Crystal Display), PDP(Plasma Display Panel), FED(Field Emission Display), OLED(Organic Light Emitting Diodes), etc. However, among such flat panel display devices, the LCD devices are spotlighted because of characteristics of massive production, easy driving, high quality, and a large screen.

Especially, an active matrix-type LCD device where a thin film transistor (TFT) is used as a switching device, is suitable for displaying moving images.

FIG. 1 is a view schematically showing part of an active matrix-type liquid crystal display (LCD) device in accordance with the conventional art. The active matrix-type LCD device includes an LC panel 1 for displaying images. The LC panel 1 is provided with a plurality of gate lines (GL1~GLn), a plurality of data lines (DL1~DLm) crossing the gate lines, a switching device (thin film transistor, T) formed at each crossing point, and a pixel (PX) connected to the switching device. Under such configuration, the LC panel 1 is configured to conduct the switching device (T) by a gate driving voltage supplied from the gate lines (GL1~GLn), and to display images by applying a data voltage to the pixel (PX) through the data lines (DL1~DLm).

As shown in FIG. 1, the conventional LCD device has a structure where a single gate line and a single data line are allocated to each switching device (T), and pixels included in a single horizontal line are driven for 1 horizontal period (1H). However, as the LC panel 1 has a large area and high resolution, the number of the gate lines (GL1~GLn) and the data lines (DL1~DLm) increases. This may increase the number of ICs for supplying a gate driving voltage and a data driving voltage to each line, resulting in increase of the fabrication costs.

In order to solve such problem, an LCD device having a double rate driving (DRD) structure and a MUX structure has been proposed. According to the DRD structure, neighboring switching devices (T) share data lines (DL1~DLm), so that the number of lines and data driving units is reduced. According to the MUX structure, a prescribed number of data lines adjacent to each other are grouped by a multiplexer (MUX) to thus selectively drive the data lines. This can reduce the number of data driving units to thereby reduce the fabrication costs.

FIG. 2 is a view showing part of an LCD device to which a MUX structure has been applied.

As shown, the LCD device having a MUX structure includes an LC panel 14 having an active area (A/A) for displaying images, and a non-active area (N/A) disposed at an outer side of the active area (A/A). A plurality of gate lines (GL1~GLn) and data lines (DL1~DLm) cross each other on the active area of the LC panel 10. A thin film transistor (T) serving as a switching device and a pixel (PX) connected to the switching device are provided at each crossing point.

Data lines (DL1~DL3) sorted as a group in three, and a single link line (LL) connected to a data driving unit (not shown) are connected to each other through first to third M transistors (MT1~MT3), respectively, on the non-active area (N/A). The first to third M transistors (MT1~MT3) are sequentially turned-on, for a first horizontal period (1H), by a MUX controller (not shown) mounted at a timing controller. As a result, a data voltage for three data lines (DL1~DL3) can be output from output terminals of a single data driving unit.

In the LCD device having a MUX structure, pixels are charged for a period of ⅓H obtained by dividing one horizontal period (1H) into three. Such conventional structure has a difficulty in being applied to an LCD device having a general amorphous silicon TFT having a low current characteristic due to a short pixel charging period. Rather, the conventional structure is applied to an LCD device using an oxide silicon or poly silicon TFT having a high current characteristic.

The oxide TFT has a high current characteristic. However, if a DC voltage is continuously applied to the gate, a device characteristic may be lowered by the degraded TFT due to threshold voltage shift.

SUMMARY OF THE INVENTION

Therefore, an aspect of the detailed description is to provide a thin film transistor (TFT) compensation circuit, capable of compensating for a TFT having a lowered device characteristic due to threshold voltage shift, in an LCD device using an oxide silicon TFT.

To achieve these and other advantages and in accordance with the purpose of this specification, as embodied and broadly described herein, there is provided a liquid crystal display (LCD) device, comprising: a liquid crystal (LC) panel having a display area where a plurality of gate lines and data lines cross each other, and a pixel including a first thin film transistor (TFT) is formed at each crossing point, the LC panel having a non-display area where a second TFT is formed; a gate driving unit mounted at one side of the LC panel, and configured to apply a gate output voltage to the pixel through the gate line; a data driving unit connected to one side of the LC panel, and configured to apply a data voltage to the pixel through the data line; a timing controller configured to control the gate driving unit and the data driving unit; a power supply unit configured to generate a plurality of driving voltages; and a threshold voltage compensation unit configured to compensate for a shifted threshold voltage by sensing the degree of threshold voltage shift of the second TFT, by controlling one of the driving voltages based on the sensing result, and by applying the driving voltage to the second TFT.

One of the driving voltages may be a power voltage ($V_{DD}$).

The power supply unit may include a voltage generating portion having a plurality of output terminals for outputting the driving voltages, and a feedback terminal for feed backing the power voltage; and a voltage dividing portion having a first resistance serially-connected between the power voltage ($V_{DD}$) output terminals and the feedback terminal of the voltage generating portion, and a second resistance connected to the first resistance in parallel.

The threshold voltage compensation unit may include a dummy TFT (DT) having a grounded source, and having a drain connected between the first resistance and the second resistance of the voltage dividing portion, and configured to apply an output signal by a shifted threshold voltage to the feedback terminal, in correspondence to a dummy signal.

The dummy signal may be a signal of which voltage level is fixed as a high level.

The dummy signal may be a gate high voltage (VGH) of the gate driving unit.

Active layers of the second TFT and the dummy TFT may be formed of oxide.

The second TFT and the dummy TFT may have a double gate structure having two gate electrodes.

At one side of the LC panel, may be formed a MUX unit configured as the second TFT for selectively conducting at least one of the two data lines.

The gate driving unit may be a shift register to which at least two second TFTs are connected.

The shift register may include: a first SR transistor (T1) configured to receive a start signal or a previous stage output signal, and to apply a high voltage to a Q node; a 2-1$^{th}$ SR transistor (T2-1) diode-connected to the first SR transistor (T1), and configured to apply a received odd power voltage ($V_{DD}$_o) to a Qb_o node (Qb_o); a 2-2$^{th}$ SR transistor (T2-2) diode-connected to the 2-1$^{th}$ SR transistor (T2-1), and configured to apply a received even power voltage ($V_{DD}$_e) to a Qb_e node (Qb_e); a 3-1$^{th}$ SR transistor (T3-1) configured to apply a ground voltage to the Q node (Q) according to a voltage level of the Qb_o node (Qb_o); a 3-2$_{th}$ SR transistor (T3-2) configured to apply the ground voltage to the Q node (Q) according to a voltage level of the Qb_e node (Qb_e); a fourth SR transistor (T4) configured to apply the ground voltage to the Q node (Q) according to a next stage output signal; a 5-1$^{th}$ SR transistor (T5-1) configured to apply the ground voltage to the Qb_o node (Qb_o) according to a voltage level of the Q node (Q); a 5-2$^{th}$ SR transistor (T5-2) configured to apply the ground voltage to the Qb_e node (Qb_e) according to a voltage level of the Q node (Q); a sixth SR transistor (T6) configured to output a clock signal (CLK) to the gate line according to a voltage level of the Q node (Q); a 7-1$^{th}$ SR transistor (T7) configured to output the ground voltage to the gate line according to a voltage level of the Qb_o node (Qb_o); and a 7-2$^{th}$ SR transistor (T7-2) configured to output the ground voltage to the gate line according to a voltage level of the Qb_e node (Qb_e).

The odd power voltage ($V_{DD}$_o) and the even power voltage ($V_{DD}$_e) may be voltages of which phases are inversed from each other.

Among the 3-1$^{th}$, 3-2$^{th}$, 5-1$^{th}$, 5-2$^{th}$, 7-1$^{th}$ and 7-2$^{th}$ TFTs, at least one may have a double gate structure having two gate electrodes.

The controlled driving voltage ($V_{DD}$) may be applied to one of the two gate electrodes of the second TFT.

The controlled driving voltage ($V_{DD}$) may be applied to a top gate electrode formed above the active layer, among the two gate electrodes.

The present invention may have the following advantages.

As the compensation circuit including the dummy TFT is formed on the non-display area of the LC panel, the degree of threshold voltage shift of the DT due to a DC voltage can be sensed. Based on the sensed result, a threshold voltage of the second TFT can be compensated. This can reduce lowering of a device characteristic.

Further scope of applicability of the present application will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings.

DETAILED DESCRIPTION OF THE INVENTION

Description will now be given in detail of the exemplary embodiments, with reference to the accompanying drawings. For the sake of brief description with reference to the drawings, the same or equivalent components will be provided with the same reference numbers, and description thereof will not be repeated.

Hereinafter, a liquid crystal display (LCD) device having a thin film transistor (TFT) compensation circuit according to the present invention will be explained in more detail with reference to the attached drawings.

Figure 1:
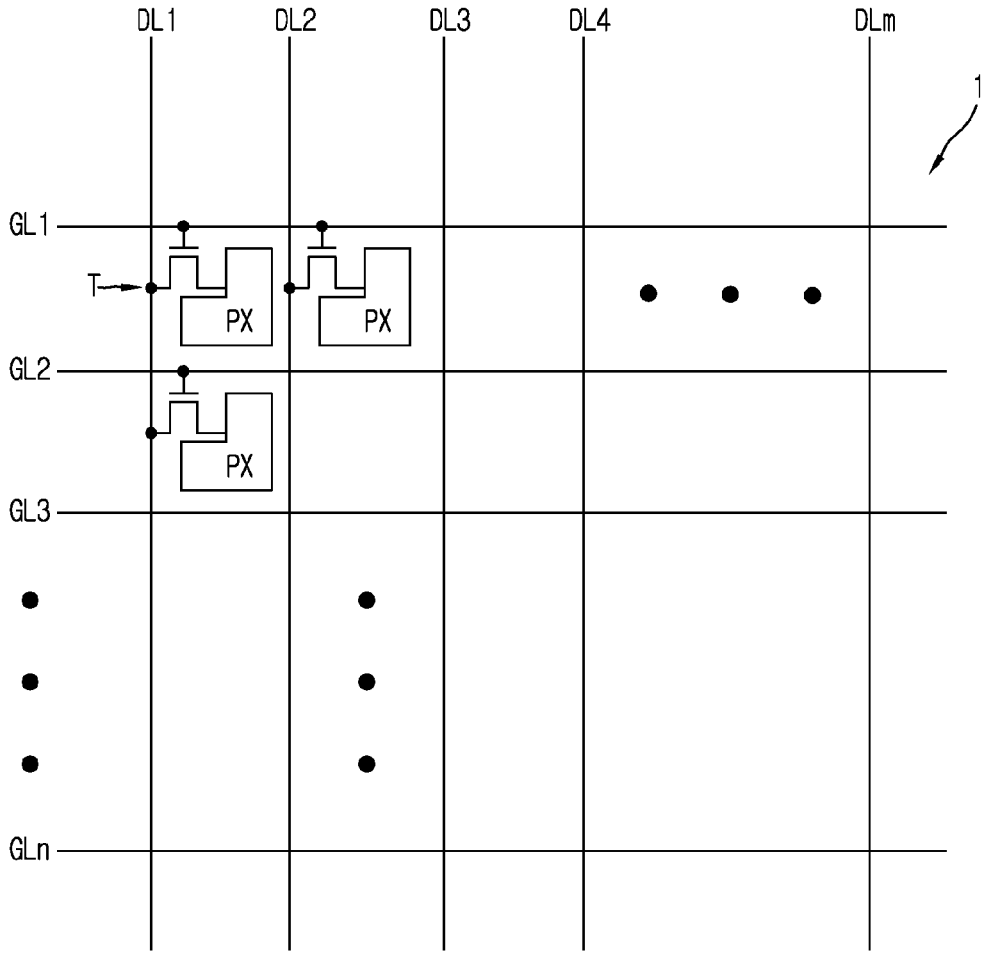
FIG. 1 RELATED ART
FIG. 1 is a view schematically showing part of an active matrix-type liquid crystal display (LCD) device in accordance with the conventional art.
Figure 2:
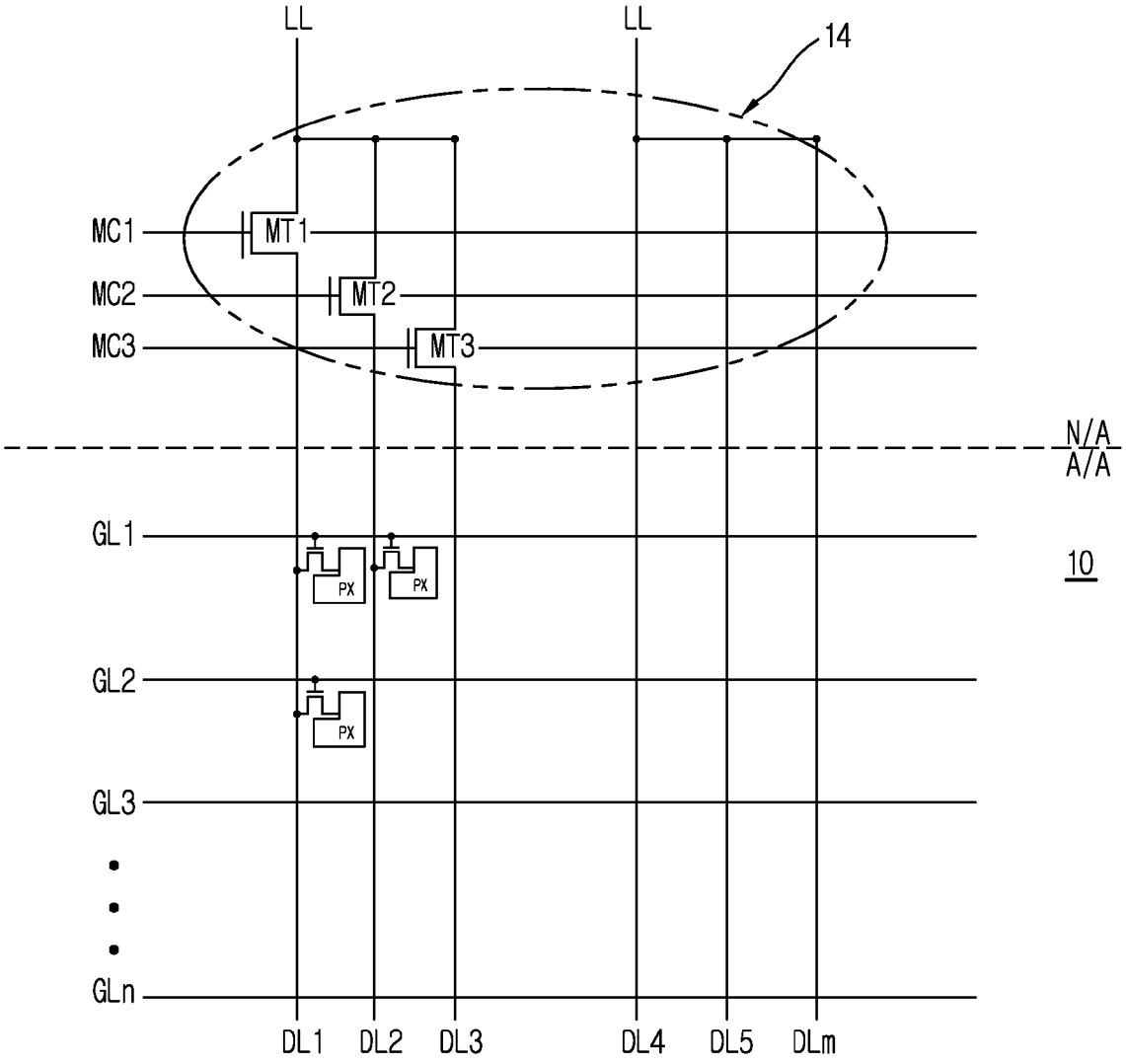
FIG. 2 RELATED ART
FIG. 2 is a view showing part of an LCD device to which a MUX structure has been applied.
Figure 3:
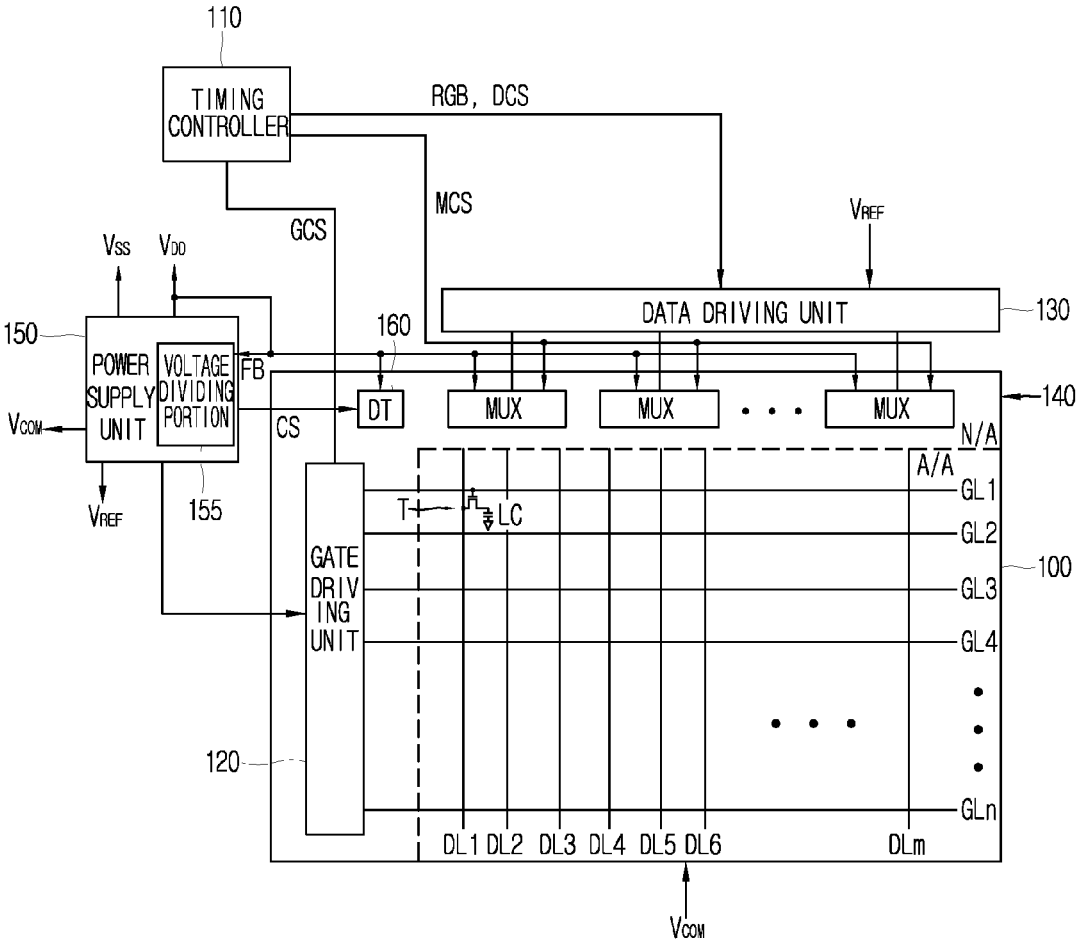
FIG. 3 is a view showing an entire structure of an LCD device according to a first embodiment of the present invention.

FIG. 3 is a view showing an entire structure of an LCD device according to a first embodiment of the present invention.

As shown, the LCD device according to the first embodiment of the present invention comprises an LC panel 100 having a display area for displaying an image, and a non-display area disposed at an outer side of the display area; a timing controller 110 configured to supply an image signal and a control signal received from an external system to each driving circuit; a gate driving unit 120 mounted at one side of the LC panel 100, and configured to apply a gate driving voltage to gate lines (GL1~GLn); a data driving unit 130 configured to apply a data voltage to each pixel; a MUX unit 140 mounted at one side of the LC panel 100, and configured to select one of data lines (DL1~DLm) to which a data voltage is output; a power supply unit 150 configured to generate and supply various types of driving voltages required to drive the LCD device; and a threshold voltage compensation unit 160 formed at one side of the non-active area (N/A) of the LC panel, and configured to compensate for a threshold voltage (Vth) by sensing the degree of threshold voltage shift of TFTs, by controlling one of driving voltages based on the sensing result, and then by applying the driving voltage to the TFTs having a shifted threshold voltage.

The LC panel 100 includes a plurality of gate lines (GL1~GLn) and a plurality of data lines (DL1~DLm) crossing each other in the form of matrices on a substrate formed of glass or plastic, and a plurality of pixels formed at the crossing points. A plurality of pixels corresponding to red, green and blue (R, G, B) colors, are implemented on the active area (A/A) of the LC panel 100 in the form of matrices. Each pixel is configured to display an image by at least one first thin film transistor (T) and at least one LC capacitor (LC).

A gate electrode of the first TFT (T) is connected to gate lines (GL1~GLn), a source electrode thereof is connected to data lines (DL1~DLm). And, a drain electrode thereof is connected to a pixel electrode facing a common electrode, thereby defining a single pixel. The first TFT (T) has a bottom gate structure where a gate electrode is formed below an active layer. The active layer of the first TFT (T) is generally formed of amorphous silicon. However, the active layer of the first TFT (T) of the LCD device is preferably formed of oxide silicon.

An active layer of a second TFT (not shown) on the non-non-active area (N/A) rather than the active area (A/A) is also formed of oxide silicon. The TFT formed of oxide silicon will be later explained in more detail.

The timing controller 110 receives digital type image signals (RGB) supplied from an external system, and timing signals (not shown) such as horizontal synchronization signals (Hsync), vertical synchronization signals (Vsync) and data enable signals (DE). Then, the timing controller 110 generates control signals of the gate driving unit 120 and the data driving unit 130, and control signals of the MUX unit 140.

Gate control signals (GCS) supplied to the gate driving unit 120 by the timing controller 110, include Gate Start Pulse (GSP), Gate Shift Clock (GSC), Gate Output Enable (GOE), etc.

Data control signals (DCS) supplied to the data driving unit 130 by the timing controller 110, include Source Start Pulse (SSP), Source Shift Clock (SSC), Source Output Enable (SOE), etc. The timing controller 110 generates MUX control signals for controlling selection of the MUX unit 140. The MUX control signals (MCS) are clock signals where high and low levels are alternate with each other per ⅓horizontal period (⅓H).

And, the timing controller 110 receives image signals (RGB) from the outside by a general interface method, and the received image signals (RGB) are aligned so as to be processed by the data driving unit 130.

The gate driving unit 120 is a shift register to which a plurality of stages are connected, each stage including a plurality of second thin film transistors (TFT) in a non-active area (N/A) at one side of the LC panel 100. And, the gate driving unit 120 is configured to sequentially output gate driving voltages of a high level, per horizontal period (1H), through the gate lines (GL1~GLn) formed on the LC panel 100, in response to the gate control signals (GCS) input from the timing controller 110. Under such configuration, the first TFT (T) connected to the gate lines (GL1~GLn) is turned on. And, the data driving unit 130 applies, through the data lines (DL1~DLm), an analogue type data voltage to pixels connected to the first TFT (T).

The data driving unit 130 converts digital type image signals (RGB) input from the timing controller 110 in correspondence to data control signals (DCS) input from the timing controller 110, into an analogue type data voltage based on a reference voltage. The data driving unit 130 is configured as an additional IC, and is attached to the non-display area on one side of the LC panel 100 by a TAB or OOG method. And, the data driving unit 130 is connected to the data lines (DL1~DLm) through link lines on the non-active area (N/A). One link line is allocated with three data lines (DL1~DLm).

The data voltage is output to the LC panel 100 through ⅓of the data lines (DL1~DLm), per ⅓horizontal period (⅓H), with respect to pixels arranged on a single horizontal line. That is, a data voltage is applied to $1^{st}$ data line (DL1), $4^{th}$ data line (DL4) and 3m-$2^{th}$ data line (DL3m-2) for ⅓horizontal period (⅓H). Then, a data voltage is applied to $2^{nd}$ data line (DL2), $5^{th}$ data line (DL5) and 3m-$1^{th}$ data line (DL3m-1) for ⅓horizontal period (⅓H). Then, a data voltage is applied to $3^{rd}$ data line (DL3), $6^{th}$ data line (DL6) and 3$m^{th}$ data line (DL3m) for ⅓horizontal period (⅓H). As a result, the data voltages are applied to the pixels on a single horizontal line.

The MUX unit 140 is formed on the non-active area(N/A) of the LC panel 100, and is configured as second thin film transistors (TFTs) between the active area (A/A) and the data driving unit 130. Three second TFTs connect one output terminal of the data driving unit 130, to three neighboring data lines selected from the data lines (DL1~DLm). Under such configuration, the MUX unit 140 receives MUX control signals (MCS) from the timing controller 110, thereby selecting one of the three data lines to which a data voltage is being currently output.

The second TFT has a double gate structure where gate electrodes are formed above and below an active layer. MUX control signals (MCS) are applied to a lower bottom gate electrode from the timing controller 110, and a controlled power voltage ($V_{DD}$) is applied to an upper top gate electrode from a power supply unit 150 which will be later explained. The controlled power voltage ($V_{DD}$) is a threshold voltage compensation signal, which is a signal obtained by controlling a level of a power voltage ($V_{DD}$) according to the degree of threshold voltage shift of the second TFT sensed by a threshold voltage compensation unit 160 to be later explained.

As a high voltage is continuously applied to the second TFT for a short time period, threshold voltage shift due to stress may occur. In order to solve such problem, a voltage more than a shifted threshold voltage is applied to the top gate electrode, based on the degree of threshold voltage shift sensed by the threshold voltage compensation unit. As a result, a back channel is formed to compensate for a current. This can compensate for a threshold voltage by increasing a voltage (Vgs) between gate and source electrodes of the second TFT having a lowered current characteristic due to degradation.

The power supply unit 150 serves to generate and supply various types of driving voltages for driving the LCD device. To this end, the power supply unit 150 includes a voltage generating portion (not shown) and a voltage dividing portion 155. The driving voltages generated by the power supply unit 150 include not only a power voltage($V_{DD}$) and a ground voltage ($V_{ss}$) commonly supplied to the LC panel 100 and each driving unit, but also a gate high voltage (VGH) which defines the upper limit of a gate output voltage, a gate low voltage (VGL) which defines the lower limit of a gate output voltage, a common voltage (Vcom), a reference voltage ($V_{REF}$) serving as a basis for converting an image signal, etc.

Especially, the power voltage($V_{DD}$), one of the driving voltages generated by the power supply unit 150, is supplied in a feedback manner, with consideration of signal delay characteristics different from each other according to the massively-fabricated LC panels 100 and the driving units. To this end, the power supply unit 150 divides the output power voltage ($V_{DD}$) by the voltage dividing portion 155 having at least one resistance device. Then, the power supply unit 150 is fedback with the power voltage ($V_{DD}$) to thus stably control a voltage level. Then, the power supply unit 150 supplies the controlled voltage to the LC panel 100 and each driving unit.

The voltage dividing portion 155 is connected to a threshold voltage compensation unit 160 to be later explained, and receives, from the threshold voltage compensation unit 160, an output signal by a shifted threshold voltage (Vth) of a dummy TFT (DT). Then, the voltage diving terminal 155 applies the received output signal, to the power voltage ($V_{DD}$) fedback to the voltage generating portion. Under such configuration, the power voltage ($V_{DD}$) output from the power supply unit 150 has a level controlled based on the degree of threshold voltage shift of the second TFT. The power supply unit 150 applies the controlled power voltage ($V_{DD}$) to the top gate of the second TFT, thereby compensating for an output according to a characteristic change.

The threshold voltage compensation unit 160 is formed in the non-active area (N/A) of the LC panel 100, and is configured to sense the degree of threshold voltage shift of the second TFT, and to supply the sensed result to the power supply unit 150. The threshold voltage compensation unit 160 is configured as a dummy TFT having the same structure as the second TFTs, and is formed on the non-active area (N/A). The threshold voltage compensation unit 160 has the same device characteristic as the second TFTs. Accordingly, a prescribed stress voltage (CS) is applied to the dummy TFT to shift a threshold voltage of the dummy TFT, so that an output signal is obtained. Based on the output signal, the degree of threshold voltage shift of the second TFT can be sensed. The output signal is applied to the power supply unit 150, and is used to generate threshold voltage compensation signals of the second TFTs.

Under such structure, the LCD device of the present invention can minimize, by the threshold voltage compensation unit, a mal-operation of the MUX unit configured as the second TFTs, the mal-operation due to threshold voltage shift.

Hereinafter, a structure of a threshold voltage compensation unit according to a first embodiment of the present invention, and a method for compensating for a threshold voltage will be explained in more detail.

Figure 4:
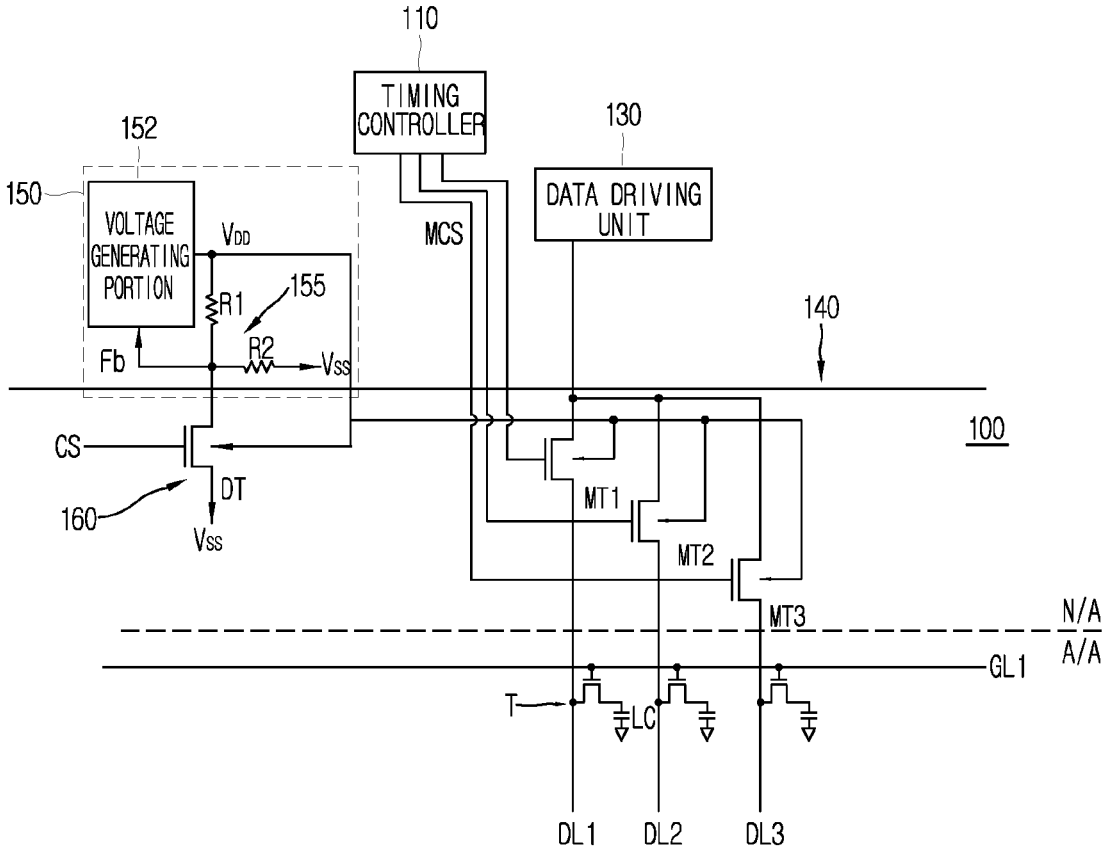
FIG. 4 is a view partially showing a threshold voltage compensation unit and an LCD device having the same according to a first embodiment of the present invention.

FIG. 4 is a view partially showing a threshold voltage compensation unit and an LCD device having the same according to a first embodiment of the present invention.

As shown, the LCD device according to the first embodiment of the present invention comprises an LC panel 100, a timing controller 110, a data driving unit 130, a MUX unit 140, a power supply unit 150, and a threshold voltage compensation unit 160 formed at one side of a non-active area(N/A) of the LC panel 100. Here, the threshold voltage compensation unit 160 is configured to compensate for a shifted threshold voltage of second TFTs by sensing the degree of threshold voltage shift of a dummy TFT on the non-active area (N/A) of the LC panel 100, by controlling one of driving voltages based on the sensing result, and then by applying the driving voltage to the second TFTs.

In drawings, the timing controller 110, the data driving unit 130 and the power supply unit 150 are formed on an additional printed circuit board (PCB), and are connected to the LC panel 100. However, the data driving unit 130 may be directly mounted on the non-active area (N/A) of the LC panel 100 by a COG method.

The power supply unit 150 includes a voltage generating portion 152 for generating a plurality of driving voltages, and a voltage dividing portion 155 for dividing a power voltage ($V_{DD}$) among driving voltages and feedbacking the divided power voltage to the voltage generating portion 152. The power supply unit 150 is mounted on an additional printed circuit board (PCB), thus to be connected to the LC panel 100. The voltage dividing portion 155 includes a first resistor (R1) serially-connected between a power voltage ($V_{DD}$) output terminal and a feedback terminal of the voltage generating portion 152, and a second resistor (R2) having one electrode connected to the first resistor (R1) and another grounded electrode.

A first thin film transistor (T) for connecting data lines (DL1~DL3) with an LC capacitor (LC) is formed on the active area (NA) of the LC panel 100. On the non-active area (N/A) of the LC panel 100, formed is the MUX unit 140 configured as second TFTs (MT1~MT3) for connecting three data lines (DL1~DL3) to one output terminal of the data driving unit 130, respectively. The threshold voltage compensation unit 160 including a dummy TFT (DT) having the same structure as the second TFTs (MT1~MT3), is formed at one side on the non-active area (N/A) of the MUX unit 140.

The MUX unit 140 includes three second TFTs (MT1~MT3) for connecting three data lines (DL1~DL3) to one output terminal of the data driving unit 130. The second TFTs (MT1~MT3) have a double gate structure where an active layer is formed of oxide silicone, and a bottom gate and a top gate are formed above and below the active layer.

Figure 5A:
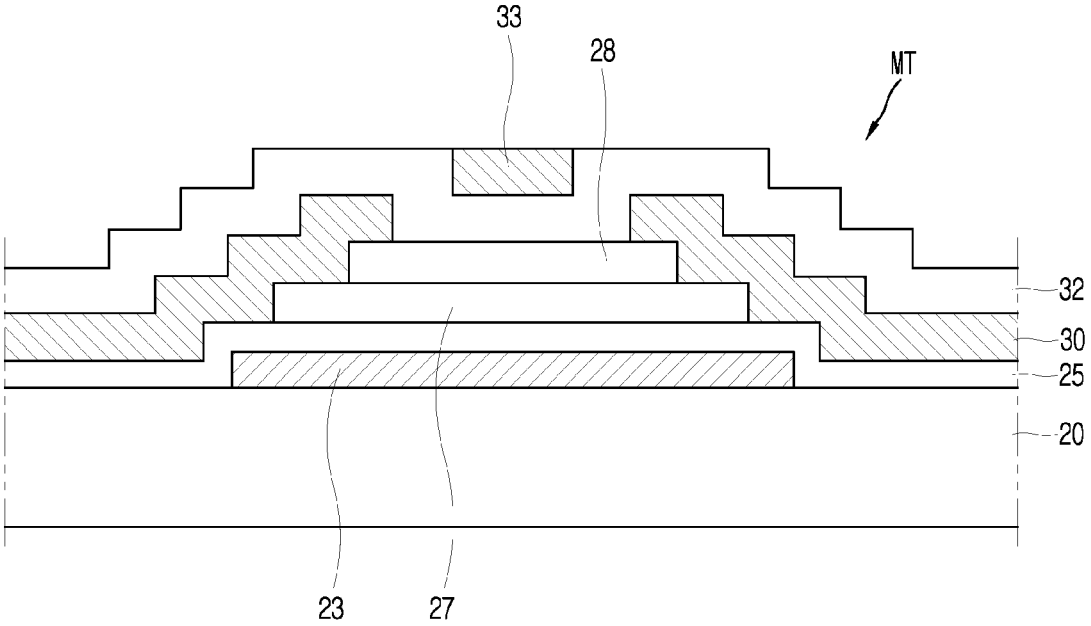
FIG. 5A is a view showing an example of an oxide thin film transistor (TFT) having a double gate structure.
Figure 5B:
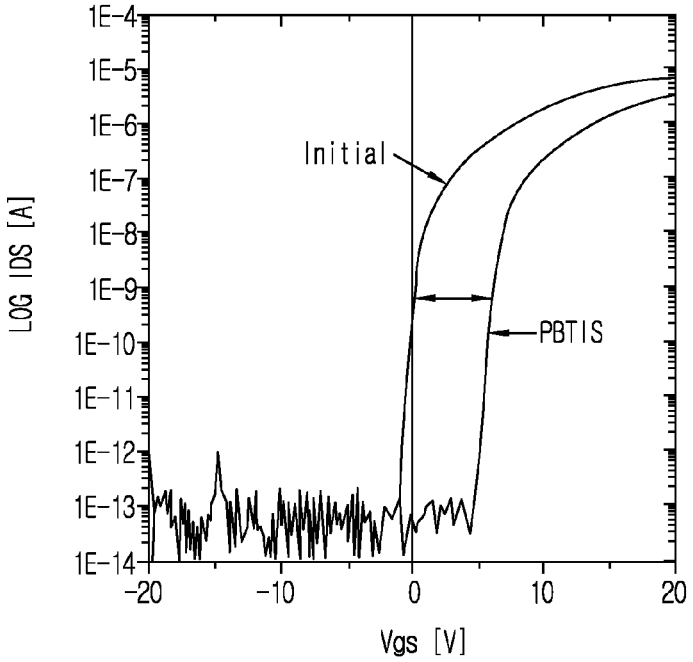
FIG. 5B is a view showing an 'I-V' characteristic of a TFT having threshold voltage shift by a stress applied thereto.

FIG. 5A is a view showing an example of an oxide thin film transistor (TFT) having a double gate structure, and FIG. 5B is a view showing an 'I-V' characteristic of a TFT having threshold voltage shift due to a stress applied thereto.

Referring to FIG. 5A, the TFT having a double gate structure includes a first gate electrode 23 formed on an insulating substrate 20, a first gate insulating layer 25 formed on an entire surface of the insulating substrate 20 including the first gate electrode 23, an active layer 27 formed on the first gate insulating layer 25 overlapping the first gate electrode 23, an etching stopping pattern 28 formed on the active layer 27, source and drain electrodes 30 formed on the active layer 27 disposed at two sides of the gate electrode 23, a passivation layer 32 formed on an entire surface of the insulating substrate including the source and drain electrodes 30, and a second gate electrode (back gate) 33 formed to correspond the first gate electrode 23.

In the TFT having a double gate structure, a channel can be formed by the second gate electrode 33. Accordingly, a current flow can be controlled through a back channel, as well as a front channel of a general TFT. As a result, an initial Ids (current between drain and source electrodes) can be controlled through threshold voltage shift.

FIG. 5B is a graph showing 'I-V' characteristics of an initial oxide TFT and an oxide TFT having threshold voltage shift. Here, the 'X'-axis denotes a voltage (Vgs) between gate and source electrodes, and the 'Y'-axis denotes a current (Ids) between drain and source electrodes. As shown, as the 'I-V' curve of the initial TFT (initial) is continuously provided with a DC voltage, the 'I-V' curve of the degraded TFT (PBTIS)

has a threshold voltage (Vth) shifted to a positive direction. Then, a controlled power voltage ($V_{DD}$) is further applied to the top-gate (i.e., second gate electrode), so that the 'I-V' curve of the degraded TFT (PBTIS) can have a threshold voltage (Vth) shifted to a negative direction. That is, as the controlled power voltage ($V_{DD}$) is further applied to the second gate electrode, a voltage (Vgs) between gate and source electrodes due to a back channel is applied to the degraded TFT. As a result, even if the same gate output voltage as the conventional one is applied to the first gate electrode, the same Ids characteristic as that prior to threshold voltage shift can be implemented.

Referring to FIG. 4 back, the threshold voltage compensation unit 160 includes a dummy TFT (DT) having a grounded source, and having a drain connected between a first resistor (R1) and a second resistor (R2) of the voltage dividing portion 155 of the power supply unit 150. The dummy TFT (DT) is configured to apply an output signal due to a shifted threshold voltage (Vth), to the feedback terminal of the voltage generating portion 152, in correspondence to a dummy signal (CS) applied to the gate electrode. The dummy TFT (DT) has the same device characteristic as the second TFTs (MT1~MT3) of the MUX unit 140. The degree of threshold voltage shift of the dummy TFT corresponds to the second TFTs (MT1~MT3). Under such configuration, the LCD device according to the first embodiment of the present invention senses changes of device characteristics of the MUX unit 140 through the dummy TFT (DT).

As the dummy signal (CS), may be used a DC voltage having a fixed level. For instance, may be used a high gate output signal (VGH) applied to a gate line (not shown). As the dummy signal (CS) is continuously applied to the dummy TFT (DT), the threshold voltage (Vth) of the DT is shifted in a positive direction. Therefore, an output signal applied to the voltage generating portion 152 by the dummy TFT (DT), is a signal to which the degree of threshold voltage shift of the DT has been reflected.

The voltage generating portion 152 is fedback with the output signal, and controls a level of the power voltage ($V_{DD}$). Then, the voltage generating portion 152 applies the power voltage ($V_{DD}$) to the second TFTs (MT1~MT3) and the dummy TFT (DT), thereby compensating for the shifted threshold voltage (Vth).

The LCD device according to the first embodiment of the present invention has a structure for compensating for threshold voltage shift of the MUX unit formed on the LC panel. Hereinafter, will be explained a structure for compensating for a leakage current due to threshold voltage shift, at a gate driving unit of an LCD device according to a second embodiment of the present invention.

Figure 6:
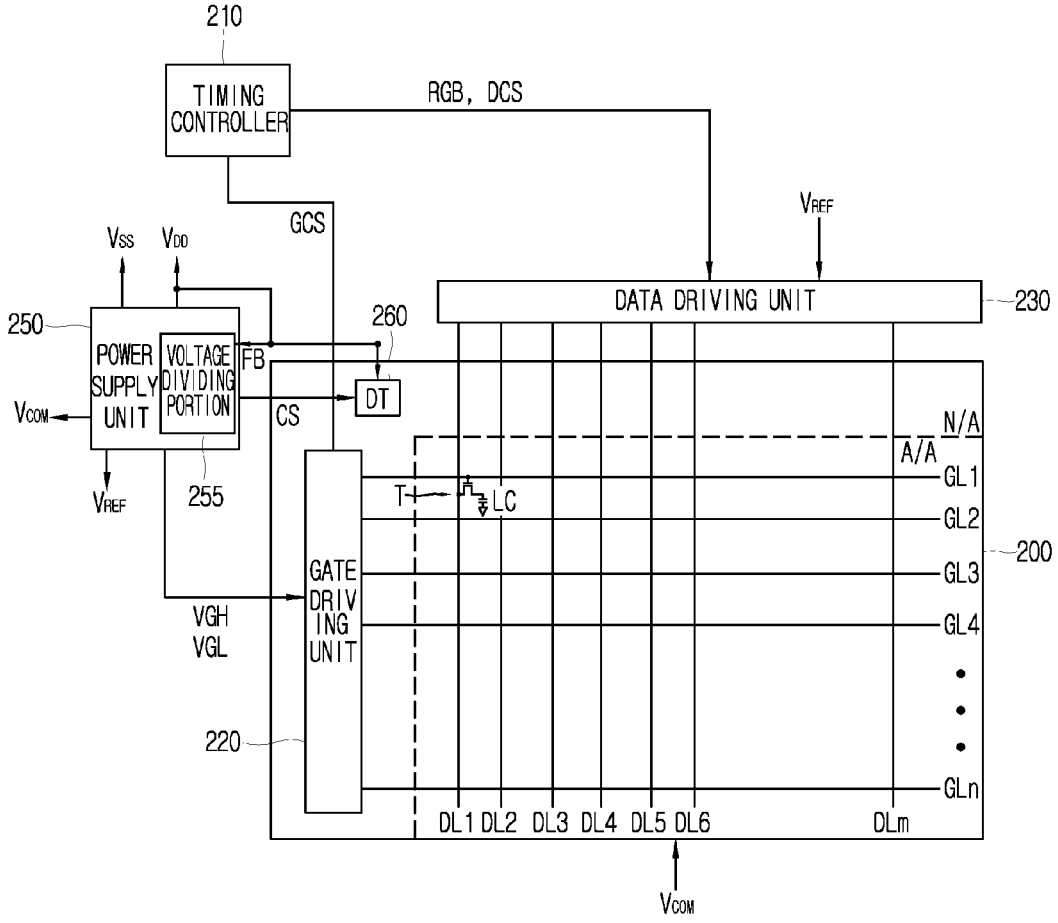
FIG. 6 is a view showing an entire structure of an LCD device according to a second embodiment of the present invention.

FIG. 6 is a view showing an entire structure of an LCD device according to a second embodiment of the present invention.

As shown, the LCD device according to the second embodiment of the present invention comprises an LC panel 200 having a active area (A/A) for displaying an image, and a non-active area (N/A) disposed at an outer side of the active area(A/A); a timing controller 210 configured to supply an image signal and a control signal received from an external system to each driving circuit; a gate driving unit 220 mounted at one side of the LC panel 200 in a gate-in-panel (GIP) structure, and configured to apply a gate driving voltage to gate lines (GL1~GLn); a data driving unit 230 configured to apply a data voltage to each pixel; a power supply unit 250 configured to generate and supply various types of driving voltages required to drive the LCD device; and a threshold voltage compensation unit 260 formed at one side of the non-active area(N/A) of the LC panel 200, and configured to compensate for a threshold voltage (Vth) by sensing the degree of threshold voltage shift of TFTs, by controlling one of driving voltages based on the sensing result, and then by applying the driving voltage to the TFTs having a shifted threshold voltage (Vth).

The LC panel 200 includes a plurality of gate lines (GL1~GLn) and a plurality of data lines (DL1~DLm) crossing each other in the form of matrices on a substrate formed of glass or plastic, and a plurality of pixels formed at the crossing points. A plurality of pixels corresponding to red, green and blue (R, G, B) colors, are implemented on the active area(A/A) of the LC panel 200 in the form of matrices. Each pixel is configured to display an image by at least one first thin film transistor (T) and at least one LC capacitor (LC).

An active layer of the first TFT (T) is preferably formed of oxide silicon. And, an active layer of a second TFT (not shown) on the non-active area (N/A) rather than the active area (A/A) is also formed of oxide silicon.

The timing controller 210 receives digital type image signals (RGB) supplied from an external system, and timing signals (not shown) such as horizontal synchronization signals (Hsync), vertical synchronization signals (Vsync) and data enable signals (DE). Then, the timing controller 210 generates control signals of the gate driving unit 220 and the data driving unit 230. And, the timing controller 210 receives image signals (RGB) from the outside by a general interface method, and the received image signals (RGB) are aligned so as to be processed by the data driving unit 230.

The gate driving unit 220 is a shift register to which a plurality of stages are connected, each stage including a plurality of second thin film transistors (TFT) in a non-active area (N/A) at one side of the LC panel 200. And, the gate driving unit 220 is configured to sequentially output gate driving voltages (VGH) of a high level, per horizontal period (1H), through the gate lines (GL1~GLn) formed on the LC panel 200, in response to the gate control signals (GCS) input from the timing controller 210. Under such configuration, the first TFT (T) connected to the gate lines (GL1~GLn) is turned on. And, the data driving unit 230 applies, through the data lines (DL1~DLm), an analogue type data voltage to pixels connected to the first TFT (T).

Some of the second TFTs of the gate driving unit 220 have a double gate structure where gate electrodes are formed above and below an active layer. Various types of signals for driving the shift register are applied to a lower bottom gate electrode, and a controlled power voltage ($V_{DD}$) is applied to an upper top gate electrode from the power supply unit 250. The controlled power voltage ($V_{DD}$) is a threshold voltage compensation signal, which is a signal obtained by controlling a level of a power voltage ($V_{DD}$) based on the degree of threshold voltage shift of the second TFTs sensed by the threshold voltage compensation unit 260.

As a high voltage is continuously applied to some of the second TFTs of the shift register for a short time period, threshold voltage shift due to stress may occur. In order to solve such problem, a voltage more than a shifted threshold voltage (Vth) is applied to the top gate electrode, based on the degree of threshold voltage shift sensed by the threshold voltage compensation unit 260. As a result, a back channel is formed to compensate for a current. This can compensate for a threshold voltage (Vth) by increasing a voltage (Vgs) between gate and source electrodes of the second TFT having a lowered current characteristic due to degradation.

The data driving unit 230 converts aligned digital type image signals (RGB) input in correspondence to data control signals (DCS) input from the timing controller 210, into an analogue type data voltage based on a reference voltage.

The power supply unit 250 serves to generate and supply various types of driving voltages for driving the LCD device. To this end, the power supply unit 250 includes a voltage generating portion (not shown) and a voltage dividing portion 255. The driving voltages generated by the power supply unit 250 include a power voltage($V_{DD}$), a ground voltage ($V_{ss}$), a gate high voltage (VGH), a gate low voltage (VGL), a common voltage (Vcom), a reference voltage ($V_{REF}$), etc.

Especially, the power voltage($V_{DD}$), one of the driving voltages generated by the power supply unit 250, is generated and supplied in a feedback manner. To this end, the power supply unit 250 divides an output power voltage ($V_{DD}$) by the voltage dividing portion 255 having at least one resistance device. Then, the power supply unit 250 is fedback with the power voltage ($V_{DD}$) to thus stably control a voltage level. Then, the power supply unit 250 supplies the controlled voltage to the LC panel 200 and each driving unit.

The voltage dividing portion 255 is connected to the threshold voltage compensation unit 260, and receives, from the threshold voltage compensation unit 260, an output signal by a shifted threshold voltage (Vth) of the second TFTs. Then, the voltage diving terminal 255 applies the received output signal, to the power voltage ($V_{DD}$) fedback to the voltage generating portion 252. Under such configuration, the power voltage ($V_{DD}$) output from the power supply unit 250 has a level controlled based on the degree of threshold voltage shift of the second TFTs. The power supply unit 250 applies the controlled power voltage ($V_{DD}$) to the top gates of the second TFTs, thereby compensating for an output according to characteristic changes of the second TFTs. The power supply unit 250 applies the controlled power voltage ($V_{DD}$) to the top gates of the second TFTs of the gate driving unit 250, thereby compensating for an output according to characteristic changes of the second TFTs.

The threshold voltage compensation unit 260 is formed in the non-active area(N/A) of the LC panel 200, and is configured to sense the degree of threshold voltage shift of the second TFT, and to supply the sensed result to the power supply unit 250. The threshold voltage compensation unit 260 is configured as a dummy TFT having the same structure as the second TFTs, and is formed on the non-active area (N/A). The threshold voltage compensation unit 260 has the same device characteristic as the second TFTs. Accordingly, a prescribed stress voltage (CS) is applied to the dummy TFT to shift a threshold voltage (Vth) of the dummy TFT, so that an output signal is obtained. Based on the output signal, the degree of threshold voltage shift of the second TFT can be sensed. The output signal is applied to the power supply unit 250, and is used to generate threshold voltage compensation signals of the second TFTs.

Under such structure, in the LCD device of the present invention, mal-operation due to threshold voltage shift of the second TFTs which constitute the shift register of the gate driving unit, can be minimized by the threshold voltage compensation unit 260.

Hereinafter, a structure of a threshold voltage compensation unit according to a second embodiment of the present invention, and a method for compensating for a threshold voltage will be explained in more detail.

Figure 7:
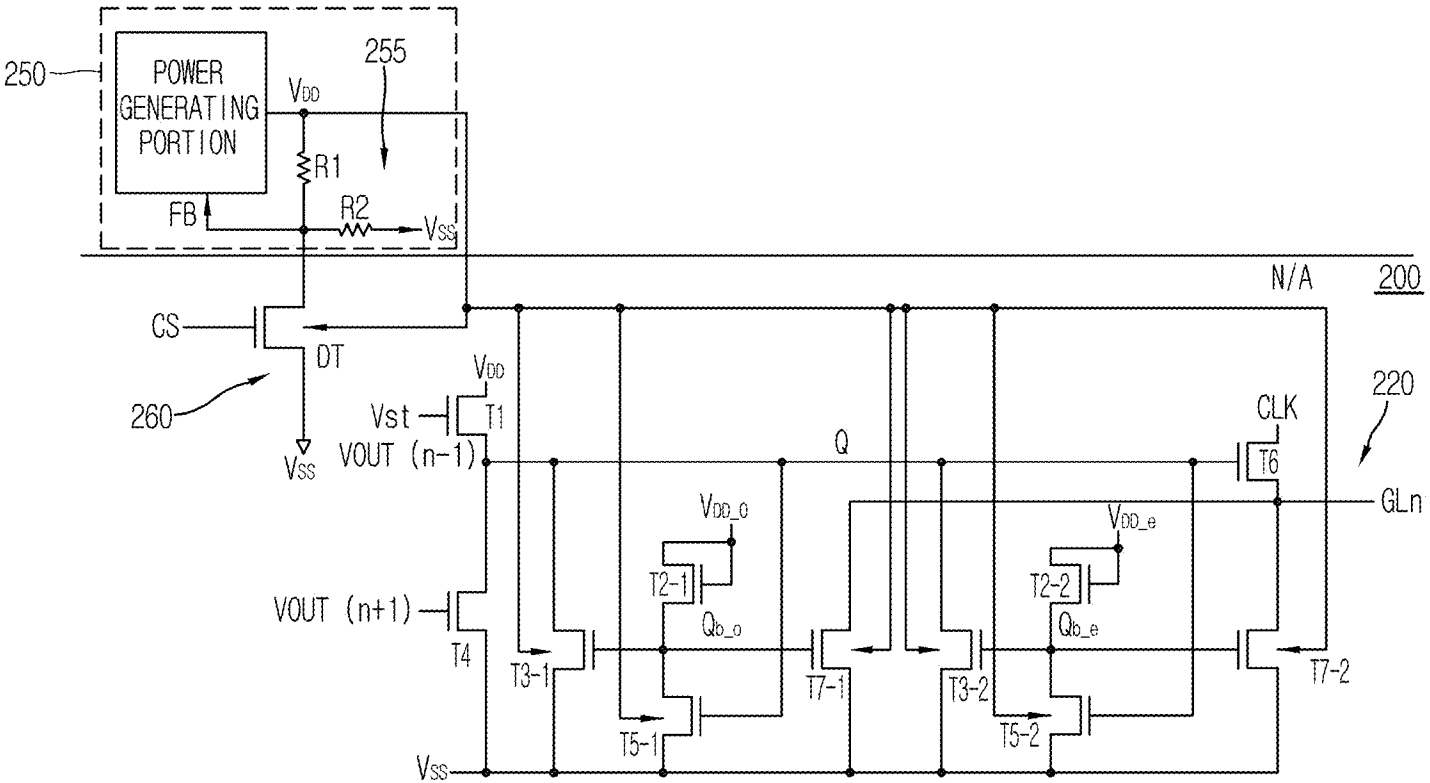
FIG. 7 is a view partially showing a threshold voltage compensation unit and an LCD device having the same according to a second embodiment of the present invention.

FIG. 7 is a view partially showing a threshold voltage compensation unit and an LCD device having the same according to a second embodiment of the present invention.

As shown, the LCD device according to the second embodiment of the present invention comprises an LC panel 200, a timing controller 210, a gate driving unit 220, a power supply unit 250, and a threshold voltage compensation unit 260 formed at one side of a non-active area (N/A) of the LC panel 200. Here, the threshold voltage compensation unit 260 is configured to compensate for a shifted threshold voltage (Vth) of second TFTs by sensing the degree of threshold voltage shift of a dummy TFT on the non-active area (N/A) of the LC panel 200, by controlling one of driving voltages based on the sensing result, and then by applying the driving voltage to the second TFTs.

The power supply unit 250 is disposed at one side of the LC panel 200, and includes a voltage generating portion 252 for generating a plurality of driving voltages, and a feedback terminal 255 for dividing a power voltage ($V_{DD}$) among driving voltages and feedback the divided power voltage to the voltage generating portion 252. The power supply unit 250 is mounted on an additional printed circuit board (PCB), thus to be connected to the LC panel 200. The feedback terminal 255 includes a first resistor (R1) serially-connected between a power voltage ($V_{DD}$) output terminal and a feedback terminal of the voltage generating portion 252, and a second resistor (R2) having one electrode connected to the first resistance (R1) and another grounded electrode.

Gate lines (GL1~GLn) connected to a first transistor (not shown) are formed on the active area (A/A) of the LC panel 200, and the end of the gate line (GLn) is connected to the gate driving unit 220 formed on the non-active area (N/A). The gate driving unit 220 is a shift register to which a plurality of stages are connected, each stage including a plurality of second thin film transistors (T1~T7).

A single stage of the shift register includes: a first SR transistor (T1) configured to receive a start signal or a previous stage output signal, and to apply a high voltage to a Q node; a 2-1$^{th}$ SR transistor (T2-1) diode-connected to the first SR transistor (T1), and configured to apply a received odd power voltage ($V_{DD}$_o) to a Qb_o node (Qb_o); a 2-2$^{th}$ SR transistor (T2-2) diode-connected to the 2-1$^{th}$ SR transistor (T2-1), and configured to apply a received even power voltage ($V_{DD}$_e) to a Qb_e node (Qb_e); a 3-1$^{th}$ SR transistor (T3-1) configured to apply a ground voltage to the Q node (Q) according to a voltage level of the Qb_o node (Qb_o); a 3-2$_{th}$ SR transistor (T3-2) configured to apply the ground voltage to the Q node (Q) according to a voltage level of the Qb_e node (Qb_e); a fourth SR transistor (T4) configured to apply the ground voltage to the Q node (Q) according to a next stage output signal; a 5-1$^{th}$ SR transistor (T5-1) configured to apply the ground voltage to the Qb_o node (Qb_o) according to a voltage level of the Q node (Q); a 5-2$^{th}$ SR transistor (T5-2) configured to apply the ground voltage to the Qb_e node (Qb_e) according to a voltage level of the Q node (Q); a sixth SR transistor (T6) configured to output a clock signal (CLK) to the gate line according to a voltage level of the Q node (Q); a 7-1$^{th}$ SR transistor (T7-1) configured to output the ground voltage to the gate line according to a voltage level of the Qb_o node (Qb_o); and a 7-2$^{th}$ SR transistor (T7-2) configured to output the ground voltage to the gate line according to a voltage level of the Qb_e node (Qb_e).

The reason why the number of the power voltages ($V_{DD}$) is two, is in order to minimize degradation of the SR transistors (T3, T5 and T7) connected to a Qb_o node (Qb_o) and a Qb_e node (Qb_e), by alternately driving the two nodes using two power voltages (odd power voltage ($V_{DD}$_o) and even power voltage ($V_{DD}$_e)) having phases inversed from each other. However, there is a limitation in stably improving threshold voltage shift of the SR transistors (T3, T5 and T7), even if the two nodes are alternately driven. To solve such problem, in the second embodiment of the present invention, the SR transistors (T3, T5 and T7) are configured to have a double gate structure. And, a power voltage ($V_{DD}$) controlled by the threshold voltage compensation unit is applied to the second gate electrode, thereby re-shifting the threshold voltage (Vth) shifted to a positive direction, to a negative direction.

The threshold voltage compensation unit 260 includes a dummy TFT (DT) having a grounded source, and having a drain connected between a first resistor (R1) and a second resistor (R2) of the voltage dividing portion 255 of the power supply unit 250. The dummy TFT (DT) is configured to apply an output signal by a shifted threshold voltage (Vth), to a feedback terminal of the voltage generating portion 252, in correspondence to a dummy signal (CS) applied to the gate electrode. The dummy TFT (DT) has the same device characteristic as the second TFTs (T1~T7) of the gate driving unit 220. The degree of threshold voltage shift of the dummy TFT corresponds to the second TFTs (T1~T3). As the dummy signal (CS), may be used a DC voltage having a fixed level. For instance, may be used a high gate output signal (VGH) applied to a gate line (not shown). As the dummy signal (CS) is continuously applied to the dummy TFT (DT), the threshold voltage (Vth) of the dummy TFT (DT) is shifted in a positive direction. Therefore, an output signal applied to the voltage generating portion 252 by the dummy TFT (DT), is a signal to which the degree of threshold voltage shift of the dummy TFT (DT) has been reflected.

Accordingly, the voltage generating portion 252 is fedback with the output signal, and controls a level of the power voltage ($V_{DD}$). Then, the voltage generating portion 252 applies the power voltage ($V_{DD}$) to the second TFTs (T1~T7) and the dummy TFT (DT), thereby compensating for the shifted threshold voltage (Vth).

The voltage dividing portion 255 is connected to the threshold voltage compensation unit 260, and receives, from the threshold voltage compensation unit 260, an output signal by a shifted threshold voltage (Vth) of the dummy TFT(DT). Then, the voltage diving terminal 255 applies the received output signal, to the power voltage ($V_{DD}$) fedback to the voltage generating portion 252. Under such configuration, the power voltage ($V_{DD}$) output from the power supply unit 250 has a level controlled based on the degree of threshold voltage shift of the second TFT. The power supply unit 250 applies the controlled power voltage ($V_{DD}$) to T3-1, T3-2, T5-1, T5-2, T7-1 and T7-2 each having a top gate, among the second TFTs (T1~T7), thereby compensating for an output according to a characteristic change.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A liquid crystal display (LCD) device, comprising:

a liquid crystal (LC) panel having an active area (A/A) where a plurality of gate lines and data lines cross each other, and a pixel including a first thin film transistor (TFT) is formed at each crossing point, the LC panel having a non-active area (N/A) where a second TFT is formed;

a gate driving unit mounted at one side of the LC panel, and configured to apply a gate output voltage to the pixel through the gate line;

a data driving unit connected to one side of the LC panel, and configured to apply a data voltage to the pixel through the data line;

a timing controller configured to control the gate driving unit and the data driving unit;

a voltage generating portion having a plurality of output terminals for outputting driving voltages, and a feedback terminal for feedback of a power voltage;

a voltage dividing portion having a first resistor serially-connected between a power voltage ($V_{DD}$) output terminal and the feedback terminal of the voltage generating portion, and a second resistor connected to the first resistor in parallel;

a threshold voltage compensation unit configured to compensate for a shifted threshold voltage by sensing the degree of threshold voltage shift of the second TFT, by controlling one of the driving voltages based on the sensing result, and by applying the controlled driving voltage to the second TFT, wherein the threshold voltage compensation unit includes:

a dummy TFT (DT) having a grounded source, a drain connected between the first resistor and the second resistor and a gate receiving a dummy signal and configured to apply an output signal by a shifted threshold voltage to the feedback terminal, wherein the second TFT and the dummy TFT have a double gate structure having a first and second gate electrodes, the first electrodes are connected to the timing controller or a node in the gate driving unit, and the second gate electrodes are connected to the power voltage ($V_{DD}$) output terminal.

2. The LCD device of claim 1, wherein one of the driving voltages is the power voltage ($V_{DD}$).

3. The LCD device of claim 1, wherein the dummy signal is a signal of which voltage level is fixed as a high level.

4. The LCD device of claim 1, wherein the dummy signal is a gate high voltage (VGH) of the gate driving unit.

5. The LCD device of claim 1, wherein active layers of the second TFT and the dummy TFT are formed of oxide.

6. The LCD device of claim 1, wherein a MUX unit configured as the second TFT for selectively conducting at least one of the two data lines, is formed at one side of the LC panel.

7. The LCD device of claim 1, wherein the gate driving unit is a shift register to which at least two second TFTs are connected.

8. The LCD device of claim 7, wherein the controlled driving voltage ($V_{DD}$) is applied to one of the two gate electrodes of the second TFT.

9. The LCD device of claim 1, wherein the gate driving unit includes:

a first SR transistor configured to receive a start signal or a previous stage output signal, and to apply a high voltage to a Q node;

a 2-1$^{th}$ SR transistor diode-connected to the first SR transistor, and configured to apply a received odd power voltage ($V_{DD}$_o) to a Qb_o node (Qb_o);

a 2-2$^{th}$ SR transistor diode-connected to the 2-1$^{th}$ SR transistor, and configured to apply a received even power voltage ($V_{DD}$_e) to a Qb_e node (Qb_e);

a 3-1$^{th}$ SR transistor configured to apply a ground voltage to the Q node (Q) according to a voltage level of the Qb_o node (Qb_o);

a 3-2$_{th}$ SR transistor configured to apply the ground voltage to the Q node (Q) according to a voltage level of the Qb_e node (Qb_e);

a fourth SR transistor configured to apply the ground voltage to the Q node (Q) according to a next stage output signal;

a 5-1$^{th}$ SR transistor configured to apply the ground voltage to the Qb_o node (Qb_o) according to a voltage level of the Q node (Q);

a 5-2$^{th}$ SR transistor configured to apply the ground voltage to the Qb_e node (Qb_e) according to a voltage level of the Q node (Q);

a sixth SR transistor configured to output a clock signal (CLK) to the gate line according to a voltage level of the Q node (Q);

a 7-1$^{th}$ SR transistor configured to output the ground voltage to the gate line according to a voltage level of the Qb_o node (Qb_o); and a 7-2$^{th}$ SR transistor configured to output the ground voltage to the gate line according to a voltage level of the Qb_e node (Qb_e).

10. The LCD device of claim 9, wherein the odd power voltage ($V_{DD}$_o) and the even power voltage ($V_{DD}$_e) are voltages of which phases are inversed from each other.

11. The LCD device of claim 9, wherein among the 3-1$^{th}$, 3-2$^{th}$, 5-1$^{th}$, 5-2$^{th}$, 7-1$^{th}$ and 7-2$^{th}$ TFTs, at least one has a double gate structure having two gate electrodes.

12. The LCD device of one of claims 11, wherein the controlled driving voltage ($V_{DD}$) is applied to one of the two gate electrodes of the second TFT.

13. The LCD device of claim 12, wherein the controlled driving voltage ($V_{DD}$) is applied to a top gate electrode formed above the active layer, among the two gate electrodes.

* * * * *